US011780618B2

(12) United States Patent
Kuhn

(10) Patent No.: US 11,780,618 B2
(45) Date of Patent: Oct. 10, 2023

(54) BAG FORMING, FILLING AND SEALING MACHINE COMPRISING METERING DEVICE

(71) Applicant: ROVEMA GMBH, Fernwald (DE)

(72) Inventor: Roland Kuhn, Reiskirchen (DE)

(73) Assignee: Rovema GmbH, Fernwald (DE)

( * ) Notice: Subject to any disclaimer, the term of this patent is extended or adjusted under 35 U.S.C. 154(b) by 102 days.

(21) Appl. No.: 17/428,770

(22) PCT Filed: Feb. 5, 2020

(86) PCT No.: PCT/EP2020/052792
§ 371 (c)(1),
(2) Date: Aug. 5, 2021

(87) PCT Pub. No.: WO2020/161152
PCT Pub. Date: Aug. 13, 2020

(65) Prior Publication Data

US 2022/0106066 A1 Apr. 7, 2022

(30) Foreign Application Priority Data

Feb. 8, 2019 (DE) ..... 10 2019 103 137.0

(51) Int. Cl.
*B65B 9/20* (2012.01)
*B65B 1/12* (2006.01)
(Continued)

(52) U.S. Cl.
CPC ..... *B65B 9/20* (2013.01); *B65B 1/12* (2013.01); *B65B 1/32* (2013.01); *B65B 1/36* (2013.01);
(Continued)

(58) Field of Classification Search
CPC .. B65B 1/32; B65B 1/363; B65B 9/20; B65B 9/213; B65B 37/005; B65B 37/16;
(Continued)

(56) References Cited

U.S. PATENT DOCUMENTS 4,779,402 A * 10/1988 Duynhoven et al. ... B65B 9/213 53/529
10,737,403 B2 * 8/2020 Bauer et al. ..... B65G 54/02
(Continued)

FOREIGN PATENT DOCUMENTS

CN 107215507 A 9/2017
CN 108502253 A 9/2018
(Continued)

OTHER PUBLICATIONS

PCT International Search Report, PCT/EP2020/052792, dated Aug. 24, 2020, 11 pages.
(Continued)

*Primary Examiner* — Stephen F. Gerrity
(74) *Attorney, Agent, or Firm* — Quarles & Brady LLP

(57) ABSTRACT

A tubular bag machine having a longitudinal sealing element having two transverse sealing jaws which are moveable against each other to transversely seal a film tube, having a mechanism which moves the transverse sealing jaws, a filling device for filling the unsealed tubular bags with a filling material, a separating element for separating individual filled tubular bags, a dosing device disposed upstream of the filling device, and a transfer element having several transfer containers between the filling device of the tubular bag machine and the dosing device. The filling material is transferred from the dosing device to the transfer containers, and the transfer containers are transported to a dispensing station along a transfer line, and the filling material is
(Continued)

transferred to the filling device, and the transfer containers are transported back along a return transfer line.

10 Claims, 4 Drawing Sheets

(51) Int. Cl.

| | |
|---|---|
| ***B65B 1/32*** | (2006.01) |
| ***B65B 1/36*** | (2006.01) |
| ***B65B 37/00*** | (2006.01) |
| ***B65B 57/16*** | (2006.01) |
| ***B65B 65/00*** | (2006.01) |
| ***B65B 37/18*** | (2006.01) |

(52) U.S. Cl.
CPC ..... *B65B 37/005* (2013.01); *B65B 37/18* (2013.01); *B65B 57/16* (2013.01); *B65B 65/006* (2013.01); *B65B 2210/02* (2013.01); *B65B 2220/14* (2013.01)

(58) Field of Classification Search
CPC ..... B65B 37/18; B65B 37/20; B65B 65/00; B65B 65/003; B65B 65/006; B65B 2210/02; B65B 2220/14
See application file for complete search history.

(56) References Cited

U.S. PATENT DOCUMENTS

| | | | | |
|---|---|---|---|---|
| 2003/0230941 | A1* | 12/2003 | Jacobs | B65B 35/52 310/12.19 |
| 2010/0059069 | A1* | 3/2010 | Boldrini | B65B 9/213 131/112 |
| 2012/0297738 | A1 | 11/2012 | Krause et al. | |

FOREIGN PATENT DOCUMENTS

| | | | | | |
|---|---|---|---|---|---|
| DE | 1152942 | B | * | 8/1963 | B65B 9/213 |
| DE | 1228553 | B | | 11/1966 | |
| DE | 29911848 | U1 | | 11/2000 | |
| DE | 102014206534 | A1 | | 10/2015 | |
| DE | 102014219448 | A1 | | 3/2016 | |
| EP | 0469105 | A1 | | 2/1992 | |
| WO | 2004106165 | A1 | | 12/2004 | |
| WO | 2009074030 | A1 | | 6/2009 | |

OTHER PUBLICATIONS

PCT English Language Translation of the International Preliminary Report on Patentability, PCT/EP2020/052792, dated Aug. 19, 2021, 9 pages.

* cited by examiner

BAG FORMING, FILLING AND SEALING MACHINE COMPRISING METERING DEVICE

This application represents the national stage entry of PCT International Application No. PCT/EP2020/052792 filed on Feb. 5, 2020, which claims the benefit of German Patent Application No. 10 2019 103 137.0 filed on Feb. 8, 2019, the entire contents of which are incorporated herein by reference for all purposes.

The disclosure relates to a tubular bag machine comprising a dosing device as used for the packaging of filling material. The tubular bag machine is equipped with a longitudinal sealing element for forming a film tube. This film tube is then sealed transversely in the tubular bag machine by means of two transverse sealing jaws which are moveable against each other and which thereby transversely seal the film tube, such that tubular bags can be produced continuously or intermittently. Before the tubular bags are sealed, the tubular bags are filled with the filling material by means of a filling device. After the tubular bags have been sealed transversely, the individual tubular bags are separated from each other by means of a separating element.

A tubular bag machine of this kind is known from EP 0 469 105, for example.

In known tubular bag machines, a dosing device is disposed upstream of the filling device. Each portion of the filling material is separated in the dosing device in order to fill the tubular bag with the prespecified quantity, for example a prespecified filling weight, a prespecified filling volume or a prespecified filling amount. In the known tubular bag machines, the dosing device operates synchronously to the tubular bag machine in order for the filling device to be able to fill the amount of filling material required for filling the tubular bag at each exact required point in time. This synchronous operation between the dosing device and the tubular bag machine increasingly leads to problems.

A first disadvantage of the synchronous operation between the dosing device and the tubular bag machine is that each little process interference during the dosing in the dosing device leads to a standstill or to an idle cycle in the tubular bag machine. In particular in the case of high-performance tubular bag machines with a performance of more than 200 tubular bags per minute, maintaining the synchronicity between the tubular bag machine and the dosing device has become extremely complex. Another disadvantage of the synchronous operation between the tubular bag machine and the dosing device is that according to the known state of the art, the dosing device must be disposed above the filling device. Since the dosing device requires an ever-increasing assembly space for maintaining the required dosing performance, the height of the space required for the assembly of the tubular bag machine with the dosing device disposed above it increases continuously.

Based on this state of the art, it is therefore the object of the disclosure to propose a new tubular bag machine which prevents the disadvantages of the state of the art mentioned above.

Advantageous embodiments of the disclosure are the subject matter of the dependent claims.

The fundamental concept of the tubular bag machine according to the disclosure is based on a transfer element having several transfer containers being provided between the filling device and the dosing device. In other words, the dosing of the necessary filling quantity of the filling material is no longer carried out by directly dispensing the filling material from the dosing device into the filling device of the tubular bag machine. Instead, the transfer element comprises an input station, in which the prespecified filling quantities for each filling of the individual tubular bags are transferred from the dosing device to one transfer container each. Subsequently, the transfer containers are transported to a dispensing station along a transfer line. Then, the transfer container is emptied into the dispensing station and the filling material is transferred from the transfer container to the filling device of the tubular bag machine. Subsequently, the transfer container returns to the input station along a return transfer line where it can be filled once again by the dosing device.

As a result, the dosing process is decoupled from the tubular bag filling process by means of the transfer element, such that the dosing device and the tubular bag machine no longer necessarily have to be operated synchronously. This decoupling in particular allows that interferences in one of the two processes do not directly cause an interference in the other process. Additionally, the transfer element allows the dosing device to operate irrespective of the position on the tubular bag machine, such that a position of the dosing device above the filling device of the tubular bag machine is not necessarily required.

The disclosure can also decrease the height at which the product is dropped and increase the performance of the process. The protection of fragile products is also increased. Transfer containers whose diameter is not consistent can be used in order to increase the emptying speed. By decoupling the dosing process and the bag-filling process, the speed of the filling process can be increased by optimized speed controls and improved opening methods.

In general, any type of tubular bag machine can be combined with the transfer element. When using a vertical tubular bag machine, disposing the transfer element between the dosing device and the tubular bag machine is especially advantageous.

The filling device can generally have any form. According to a preferred embodiment, the filling device is realized in the manner of a forming tube, the film tube being guided on the outer surface of the forming tube. Under the influence of gravity, the filling material can then be filled into the still unsealed tubular bag from above through the internal cross section of the forming tube.

There are different embodiments for each dosing device to be used. Generally, any gravimetric or volumetric dosing device or any dosing device using a metering method can be used. Depending on how the dosing is carried out, a weighing scale or a screw conveyor or a meter or a volume dosing element can be used as a dosing device.

In view of the dosing process being decoupled from the tubular bag filling process, it is especially advantageous if the transfer element is controlled by a separate control system. This transfer control system can control the transfer process in the input station irrespective of the transfer process in the dispensing station, such that the two processes are truly decoupled.

In view of correcting little process interferences, it is especially advantageous if the transfer control system can change the conveying speed of the transfer containers along the transfer line and/or along the return transfer line. In particular short delays in the area of the dosing can be easily compensated by means of such speed variations in order to ensure that the pre-dosed amount of the filling material in the dispensing station is timely dispensed, even in the event of little process interferences.

It is especially advantageous if the transfer control system can change the conveying speed of individual transfer containers irrespective of the conveying speed of the other transfer containers.

In order to be able to also compensate for larger process interferences and related process deviations between the dosing process and the tubular bag filling process, the transfer element can be equipped with at least one buffer. In this buffer, at least one filled or unfilled transfer container can be stored temporarily. In the event of a little process interference which, for example, prevents the transfer container from being filled on time, the transfer container temporarily stored in the buffer can be extracted and introduced in the transfer line or the return transfer line. In particular, it can be advantageous to provide a buffer upstream of each dispensing station.

In the basic form of the disclosure, a dosing device is connected to a tubular bag machine by means of the transfer element. According to a preferred embodiment, however, the transfer element comprises at least two input stations, at each of which filling material can be transferred from a dosing device to the transfer containers. In this manner, the required dosing performance can in particular be distributed among several dosing devices, such that for example a high-performance tubular bag machine comprising two or more dosing devices can be provided with the pre-dosed filling quantities. The individual dosing devices can then each have a correspondingly smaller dosing performance, such that high-performance dosing devices are not required in particular for the dosing of high-performance tubular bag machines.

The dosing of the filling material by means of several dosing devices and their transfer to the transfer containers at a minimum of two different input stations is in particular advantageous if the tubular bags are to be filled with a mixed filling, for example a nut mix. To mix this filling, different filling materials can be transferred to the transfer containers at the different input stations, whereby the individual transfer containers then receive the corresponding, desired mix of the filling material when arriving at the dispensing station. By individually dosing the sub-components which make up the mix, the dosing accuracy of the proportions of the sub-components in the mix is moreover increased.

Alternatively or additionally to using several input stations, the transfer element can also comprise several dispensing stations. At each dispensing station, the filling material or the material mix can be transferred from the transfer containers to the filling device of different tubular bag machines. By means of corresponding transfer elements, even complex transfer systems, in which a plurality of possibly different dosing devices can be linked to a plurality of different tubular bag machines, can be formed in this manner, thus enabling an optimized capacity alignment between the dosing capacities and the filling capacities.

Different embodiments of the disclosure are schematically illustrated in the drawings and are described in an exemplary manner hereinafter.

Figure 4:
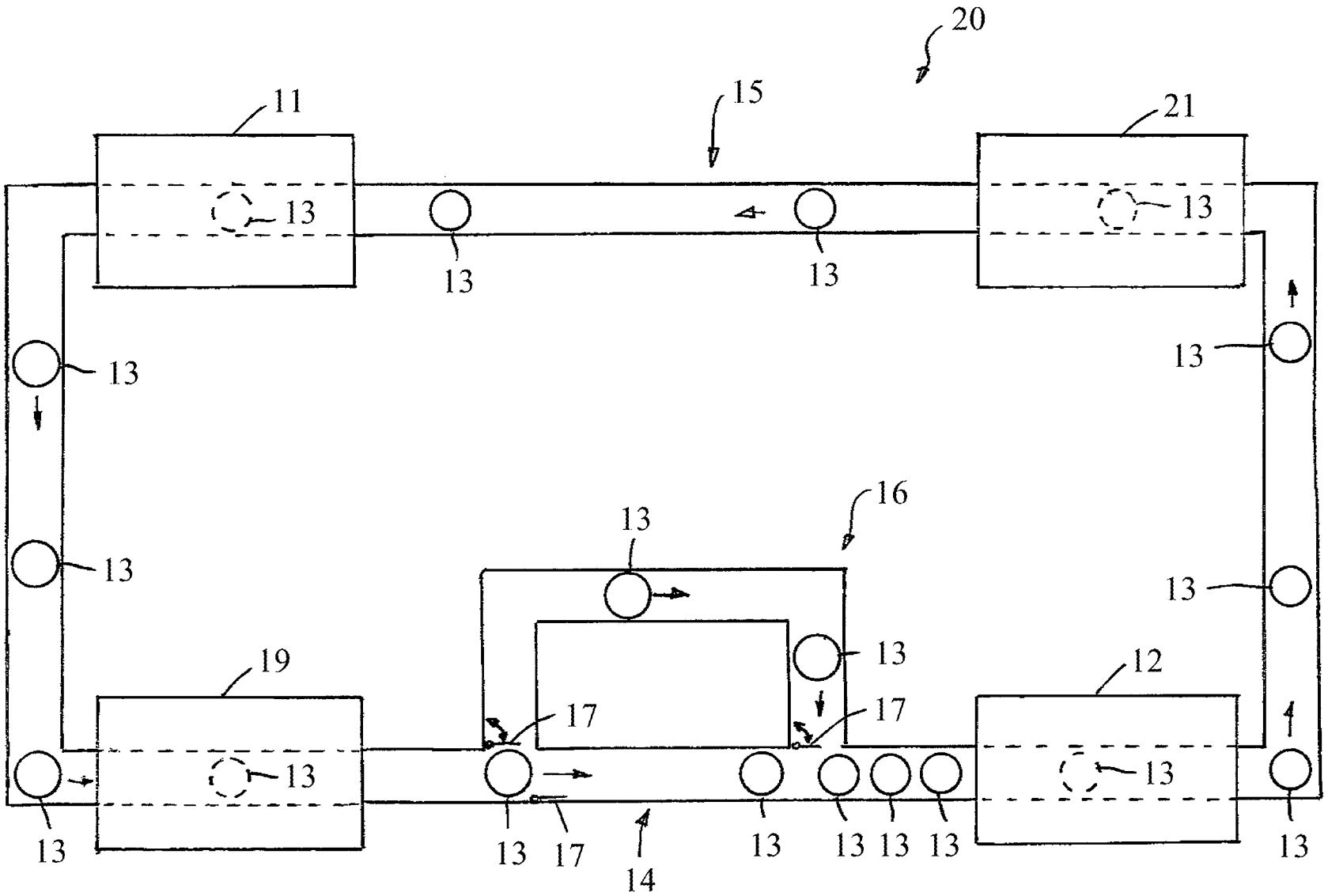

FIG. 4 a third embodiment of a transfer element in a top view.

Figure 1:
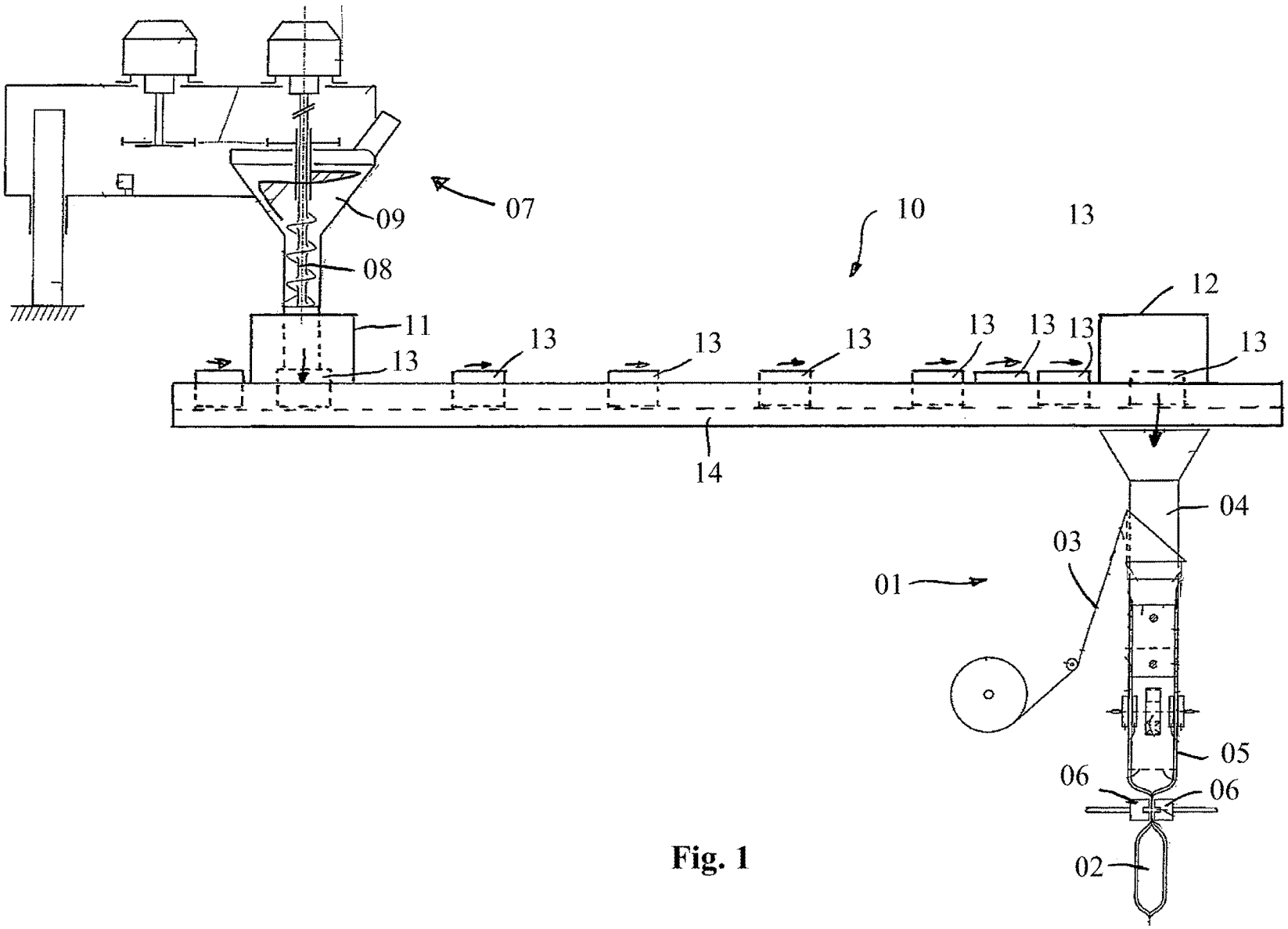
FIG. 1 shows a tubular bag machine having a dosing device disposed upstream thereof and a transfer element disposed therebetween in a side view.

FIG. 1 shows a tubular bag machine 01 for producing tubular bags 02. In the production of tubular bags 02, a packaging film 03 is first formed into a tube around a forming tube, which serves as a filling device 04, and is then sealed longitudinally. Thus formed film tube 05 is sealed transversely by means of transverse sealing jaws 06 and is thus closed at the upper or lower end. Tubular bag 02, which has not been closed at the upper end thus far, is filled with a filling material by filling device 04 during the filling process in tubular bag machine 01, the filling material falling into the still open tubular bag from above through the internal cross section of the forming tube.

A dosing device 07 is disposed upstream of tubular bag machine 01, said dosing device 07 being formed in the manner of a dosing screw 08 having a corresponding drive in the illustrated embodiment. By suitably driving dosing screw 08, a prespecified filling volume of the filling material can be discharged from a filling material funnel 09.

A transfer element 10 is disposed between tubular bag machine 01 and dosing device 07. Transfer element 10 comprises an input station 11 and a dispensing station 12. Transfer containers 13 of dosing device 07 can be filled with the pre-dosed amount of the filling material in input station 11. Subsequently, transfer containers 13 are transported along a transfer line 14 to dispensing station 12. Transfer containers 13 are emptied into dispensing station 12, such that the prespecified amount of the filling material falls into the open tubular bags from above through filling device 04. In this case, transfer containers 13 are filled in input station 11 irrespective of the emptying of transfer containers 13 in the dispensing station, such that a synchronicity between the dosing process in dosing device 07 and the tubular bag filling process in tubular bag machine 01 is no longer required. By varying the conveying speed of transfer containers 13 along transfer line 14, synchronicity deviations between the two processes can be easily compensated.

Figure 2:
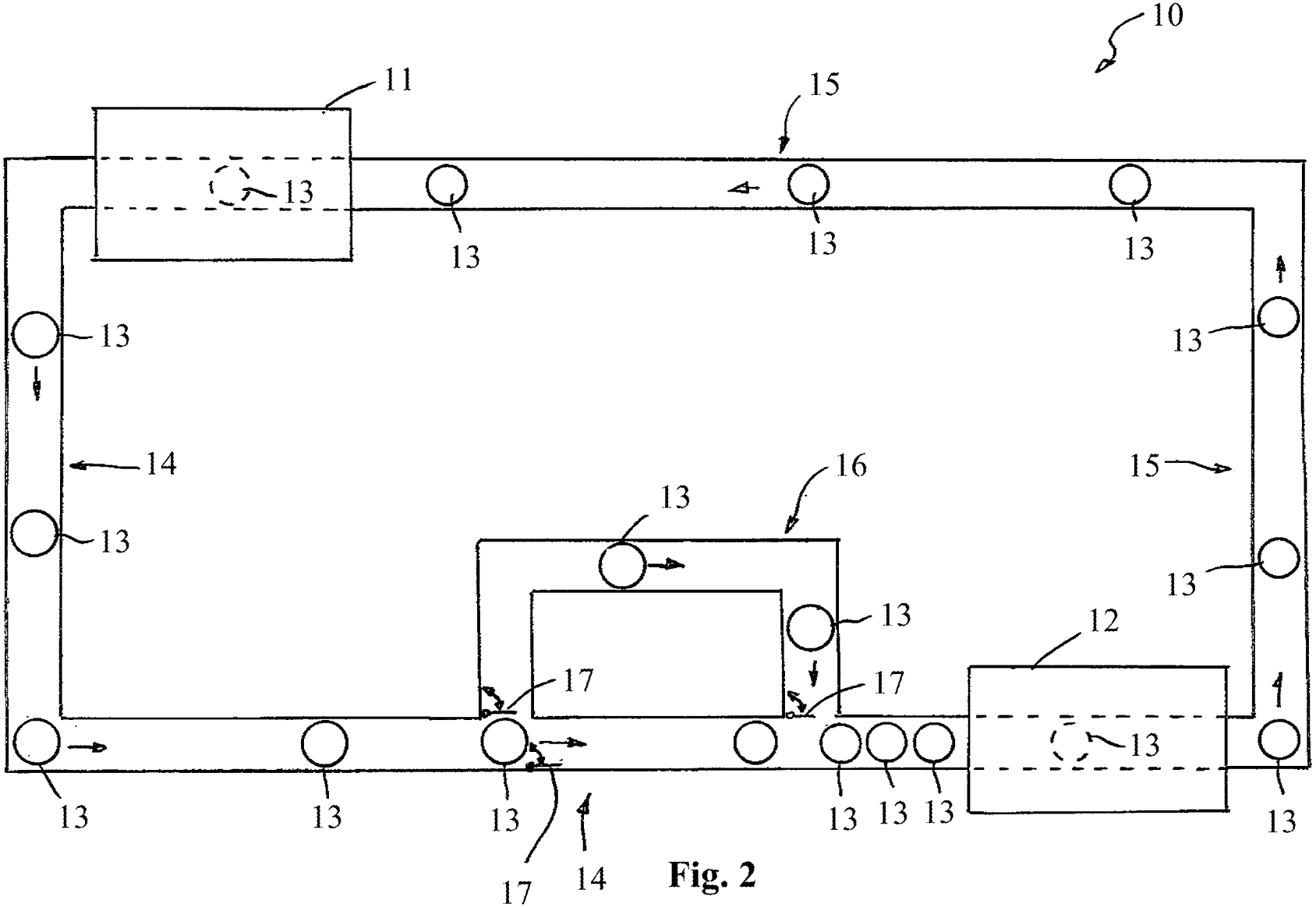
FIG. 2 shows the transfer element according to FIG. 1 in a top view.

FIG. 2 shows transfer element 10 having input station 11 and dispensing station 12 in a schematic top view. As can be seen in FIG. 2, transfer containers 13 are transported back to input station 11 along a return transfer line 15 after the emptying into dispensing station 12, such that they can be filled there once again with a pre-dosed amount of the filling material. In order to also compensate for larger synchronicity deviations between the filling of the transfer containers in input station 11 and the emptying of transfer containers 13 into dispensing station 12, transfer line 14 also comprises a buffer 16 in which several transfer containers 13 can be stored temporarily. Switch elements 17 serve for filling or emptying transfer containers 13 in buffer 16.

Figure 3:
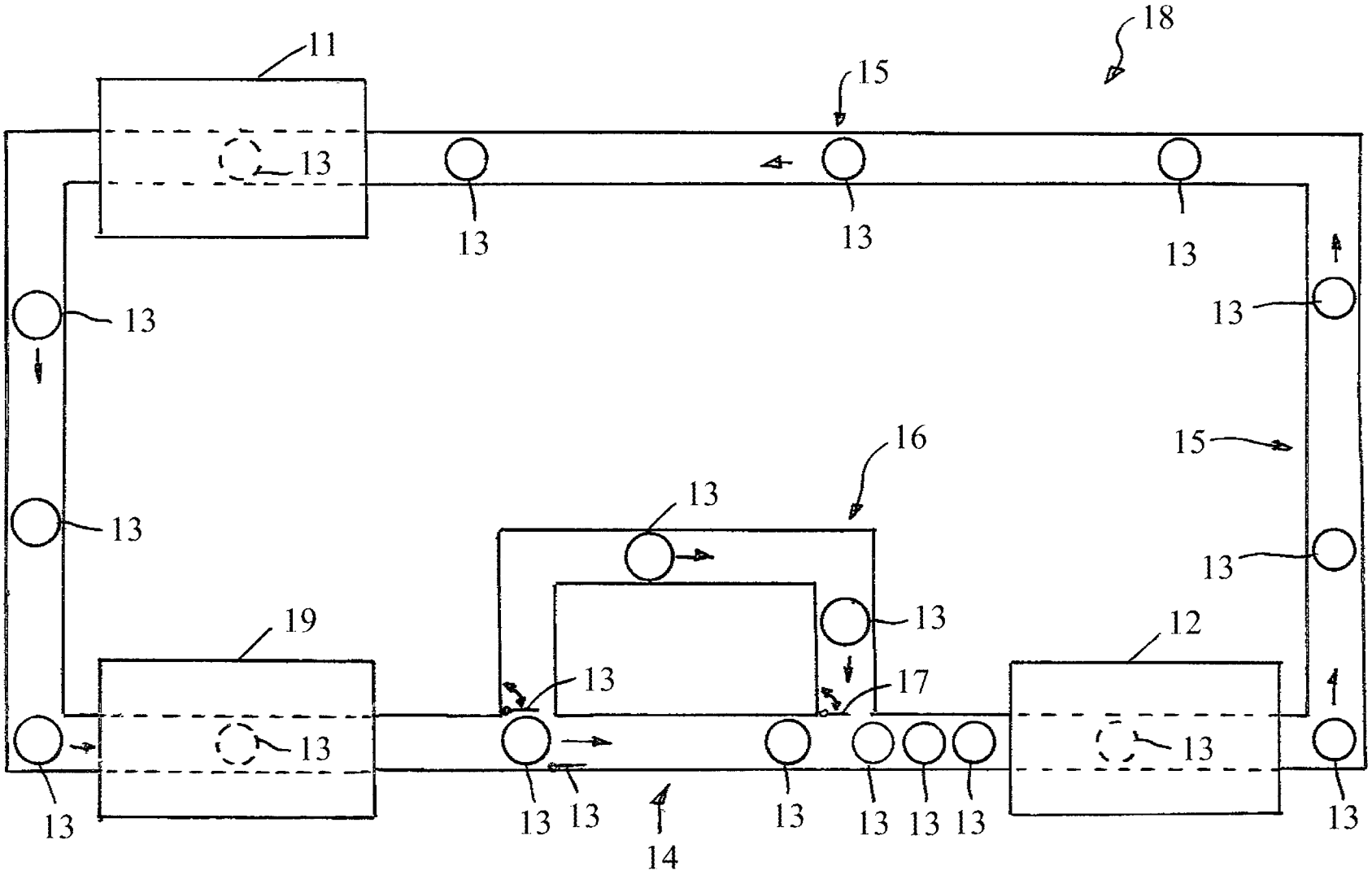
FIG. 3 shows a second embodiment of a transfer element in a top view.

FIG. 3 shows an alternative embodiment of a transfer element 18. The basic design of transfer element 18 corresponds to the design of transfer element 10, transfer element 18 comprising an additional input station 19. In turn, transfer containers 13 can be filled with pre-dosed filling quantities of a filling material at additional input station 19 using an additional dosing device. It is conceivable that different transfer containers are each filled with filling material in input stations 11 and 19 in order to increase the required dosing capacity in this manner by using two dosing devices. Alternatively, transfer containers 13 can also be filled with different filling materials each in input stations 11 and 19, such that each transfer container contains a pre-dosed mix of filling materials after leaving input station 19.

FIG. 4 shows a third embodiment of a transfer element 20. Transfer element 20 differs from transfer element 18 in that an additional dispensing station 21 is used. As a result, transfer containers 13 can, on the one hand, be filled with filling material in input stations 11 and 19 by means of transfer element 20 using different dosing devices and then, the filling materials can be dispensed to two different tubular bag machines from transfer containers 13 at dispensing stations 12 and 21. In so far as the transfer elements comprise additional input stations or dispensing stations, more complex transfer systems, which are made of a plurality of dosing devices and a plurality of tubular bag machines, can be realized.

The invention claimed is:

1. A tubular bag machine having a longitudinal sealing element for forming a film tube, having two transverse sealing jaws, which are moveable against each other and which thereby transversely seal the film tube, for forming sealed tubular bags, having a mechanism which has a drive and which moves the transverse sealing jaws EGO, having a filling device for filling the unsealed tubular bags with a filling material, having a separating element for separating individual filled tubular bags, a dosing device being disposed upstream of the filling device, said dosing device allowing for the dosing of a prespecified filling quantity of the filling material to be filled into a tubular bag, wherein a transfer element having several transfer containers is provided between the filling device of the tubular bag machine and the dosing device, the prespecified filling quantity of the filling material being transferred from the dosing device to the transfer containers in an input station, and the transfer containers being transported to a dispensing station along a transfer line, and the filling material being transferred from the transport containers to the filling device in the dispensing station, and the transfer containers being transported back to the input station along a return transfer line, and wherein the transfer element is controlled by a transfer control system, the transfer control system controlling the transfer process in the input station irrespective of the transfer process in the dispensing station.

2. The tubular bag machine according to claim 1, wherein the tubular bag machine is a vertical tubular bag machine.

3. The tubular bag machine according to claim 1, wherein the filling device is realized in the manner of a forming tube, the film tube being guided on the outer surface of the forming tube.

4. The tubular bag machine according to claim 1, wherein_the dosing device comprises at least a weighing scale or at least a screw conveyor or at least a meter or at least a volume dosing element for measuring the filling material.

5. The tubular bag machine according to claim 1, wherein the transfer control system changes the conveying speed of the transfer containers along the transfer line and/or along the return transfer line.

6. The tubular bag machine according to claim 5, wherein the transfer control system changes the conveying speed of individual transfer containers irrespective of the conveying speed of the other transfer containers.

7. The tubular bag machine according to claim 1, wherein the transfer element comprises at least one buffer, which temporarily stores at least one filled or unfilled transfer container.

8. The tubular bag machine according to claim 1, wherein the transfer element comprises at least two input stations, at each of which filling material from a dosing device is transferable to the transfer containers.

9. The tubular bag machine according to claim 8, wherein for forming a mixed filling at the different input stations, different filling materials are transferable to one transfer container each.

10. The tubular bag machine according to claim 1, wherein the transfer element comprises at least two dispensing stations, at each of which filling material from the transfer containers is transferable to filling devices of different tubular bag machines.

* * * * *